US008556265B2

(12) United States Patent
Voden

(10) Patent No.: US 8,556,265 B2
(45) Date of Patent: Oct. 15, 2013

(54) SCROLLING MULTI-GAME TABLE

(76) Inventor: Justin L. Voden, Eagle, WI (US)

( * ) Notice: Subject to any disclaimer, the term of this patent is extended or adjusted under 35 U.S.C. 154(b) by 1602 days.

(21) Appl. No.: 11/553,674

(22) Filed: Oct. 27, 2006

(65) Prior Publication Data

US 2008/0067750 A1 Mar. 20, 2008

Related U.S. Application Data

(63) Continuation-in-part of application No. 29/249,017, filed on Sep. 15, 2006, now Pat. No. Des. 568,416.

(51) Int. Cl.
*A63F 3/00* (2006.01)
*A63F 7/00* (2006.01)

(52) U.S. Cl.
USPC ..... 273/284; 273/286; 273/287; 273/309

(58) Field of Classification Search
USPC ..... 273/309, 284, 286, 287, 283
See application file for complete search history.

(56) References Cited

U.S. PATENT DOCUMENTS

| | | | | |
|---|---|---|---|---|
| 646,549 | A * | 4/1900 | Aberli | 434/153 |
| 3,672,674 | A * | 6/1972 | Reed | 273/317.5 |
| 3,926,439 | A * | 12/1975 | Chao et al. | 273/237 |
| 2005/0236772 | A1 * | 10/2005 | Chen | 273/284 |

* cited by examiner

*Primary Examiner* — Benjamin Layno
(74) *Attorney, Agent, or Firm* — Michael Best & Friedrich LLP

(57) ABSTRACT

A combination game table having a plurality of games therein includes a mechanism for scrolling a sheet having different game surfaces thereon. The combination game table includes a table frame assembly having side members and a bottom surface, and a cavity located in the table frame assembly. The mechanism is positioned in the cavity and in contact with the sheet to translate the sheet from one position to a next position. In this regard, an operator is able to view a desired game surface by translating the sheet via the mechanism.

16 Claims, 4 Drawing Sheets

FIG. 1
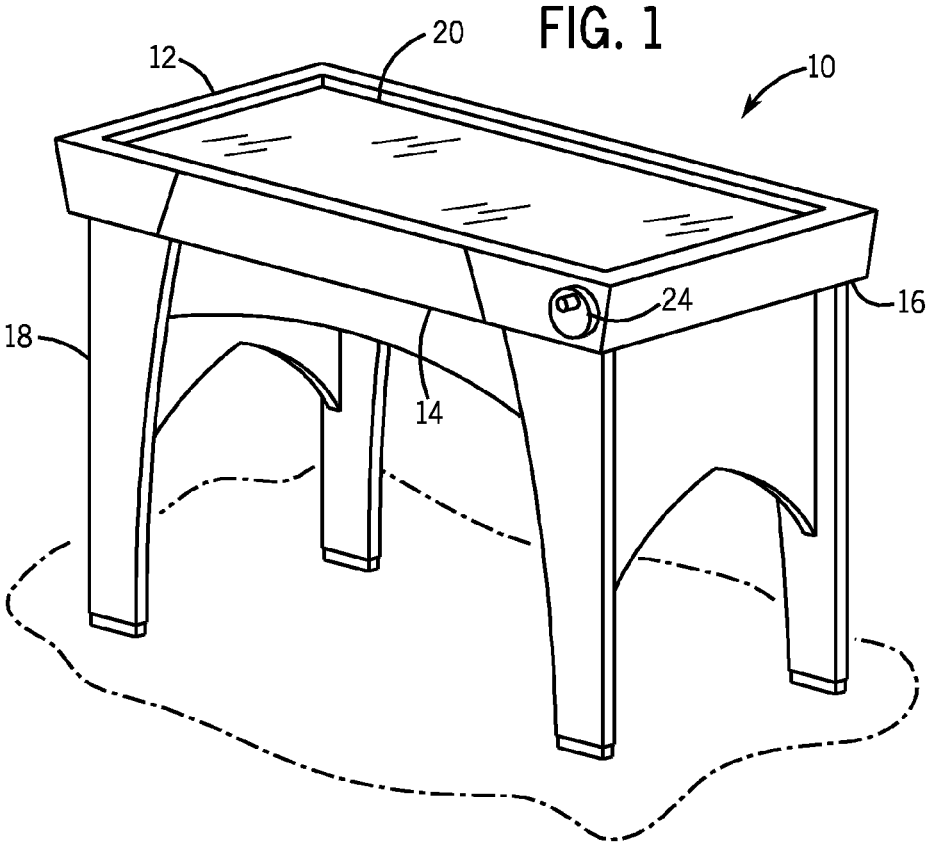
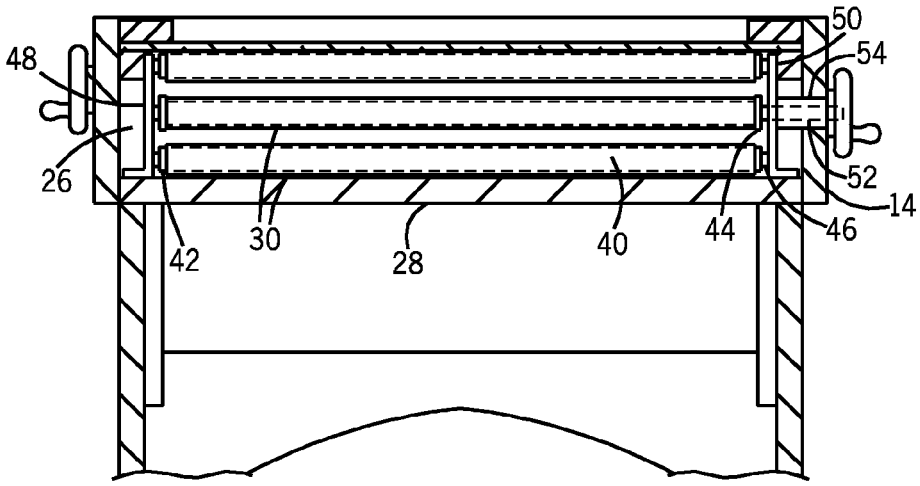
FIG. 5

SCROLLING MULTI-GAME TABLE

CROSS REFERENCE TO RELATED APPLICATION

The present invention is a continuation-in-part and claims priority of U.S. Ser. No. 29/249,017 filed Sep. 15, 2006, which is incorporated herein by reference.

BACKGROUND OF THE INVENTION

The present invention relates generally to game tables and, more particularly, to a scrolling multi-game table which allows an operator to change from one game surface to another, without having to remove or store a game surface not in use.

Various designs currently exist that allow for a game table to accommodate and switch between various gaming surfaces. One such design is a rotary game table that is rotated to provide different game surfaces on the top and bottom of the table. Such a design allows for an operator to easily switch between a first and second game surface, by merely rotating the game table and securing the desired surface in place.

Designs also exist that allow for an operator to manually add and remove different game surfaces from the multi-game table. Typically, the top of the table will accommodate each of a plurality of different game surfaces, each of which is configured to be securely fitted to the table. The operator switches between game surfaces by manually adding and removing the surfaces from the table as desired.

With these existing designs, however, there are limitations or drawbacks. For instance, with a rotary game table, the number of game surfaces on the table will normally be limited to two, with one game surface being located on a top surface of the table, and the other game surface being located on a bottom surface of the table. Thus, an operator is generally limited in the number of games available to them. With game tables that have removable, interchangeable game surfaces, there is no limit on the number of game surfaces that can be used with the table; however, existing designs require that each of these game surfaces be physically removed and set aside when not in use. Thus, when an operator desires to switch to a new game surface, he is required to manually remove a game surface not in use and store the game surface in a separate location, and further add the desired game surface to the table. Such a process of switching game surfaces is recognized as being time consuming and requiring space to store those surfaces not in use.

Thus, there exists a need for a multi-game table that allows an operator to quickly and easily select any one of a plurality of different game surfaces in an efficient manner and in a manner that does not require any addition or removal of a game surface from the multi-game table.

BRIEF DESCRIPTION OF THE INVENTION

The present invention is directed to a scrolling multi-game table that is configured to have a plurality of game surfaces housed in the table and allow for scrolling of the game surfaces from one to the next, without having to remove or externally store a game surface not in use.

Therefore, in accordance with one aspect of the present invention, a combination game table is disclosed that includes a table frame assembly having side members, end members, and a bottom surface member. The invention further includes a cavity located within the table frame assembly. A mechanism is positioned in the cavity and in contact with a sheet having a plurality of game surfaces printed thereon. The mechanism is configured to translate the sheet from one position to a next position.

According to another aspect of the present invention, a multi-game game table is disclosed. The table includes a table frame assembly, a transparent top surface member on a top side of the table frame assembly, and a plurality of rollers located in the table frame assembly. The rollers are configured to support a game belt having a plurality of game surfaces printed thereon, and are attached to a means for scrolling the game belt about the transparent top surface member to be visible therethrough.

According to yet another aspect of the invention, a method for manufacturing a combination game table is disclosed. The method includes the steps of constructing a table frame assembly having side members, end members, and a bottom surface and disposing a scrolling mechanism within a cavity formed by the table frame assembly. The method further includes the step of connecting a sheet having a plurality of game surfaces printed thereon to the scrolling mechanism, such that the scrolling mechanism is in contact with the sheet to scroll the sheet from one position to a next position.

BRIEF DESCRIPTION OF THE DRAWINGS

FIG. 1 is a perspective view of a scrolling multi-game table in accordance with the present invention.

FIG. 5 is a cross-sectioned end view of the scrolling multi-game table of FIG. 1 taken along line 5-5 of FIG. 4.

DETAILED DESCRIPTION OF THE INVENTION

Figure 2:
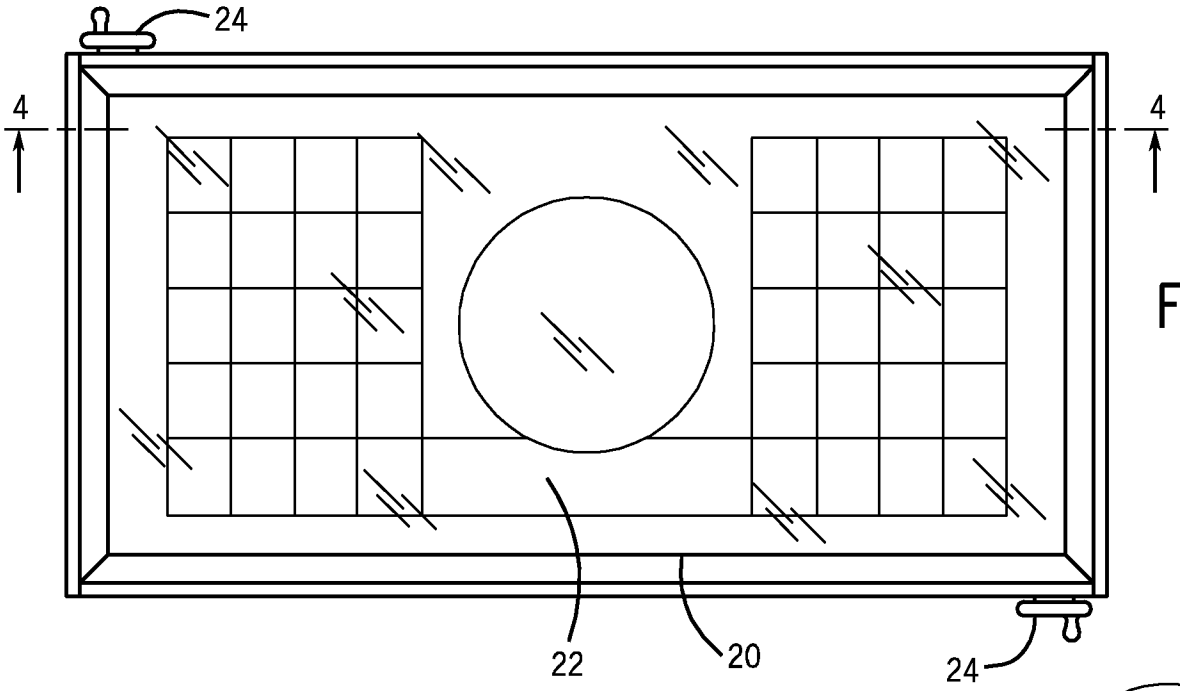
FIG. 2 is a top plan view of the scrolling multi-game table of FIG. 1.

The present invention is directed to a scrolling multi-game table that is configured to have a plurality of game surfaces housed in the table to allow for scrolling of the game surfaces from one to the next, without having to remove or externally store a game surface not in use.

Referring to FIG. 1, a scrolling multi-game table 10 is shown. A table frame assembly 12 is included in the body of the multi-game table. The table frame assembly 12, includes two elongated side members 14, two end members 16, and a bottom surface member (not shown). In a preferred embodiment, an optional leg assembly 18 is incorporated into the table frame assembly 12, to allow the multi-game table 10 to function as a stand-alone table. Leg assembly 18 provides a stable base on which to mount the table frame assembly 12. Alternatively, the multi-game table 10 may also function equivalently as a table top game, in which case the leg assembly would not be included.

Also in a preferred embodiment, a top surface 20 is attached to the table frame assembly 12. As shown in FIG. 2, top surface 20 is preferably a transparent surface to allow viewing of a game surface 22 therethrough. Top surface 20 can be composed of a ¼ inch clear durable plastic material, or any other suitable, transparent material which is resistant to cracking and scratching. Top surface 20 is secured to table frame assembly 12 in a manner well known in the art, and is not of significance in the current invention.

Figure 3:
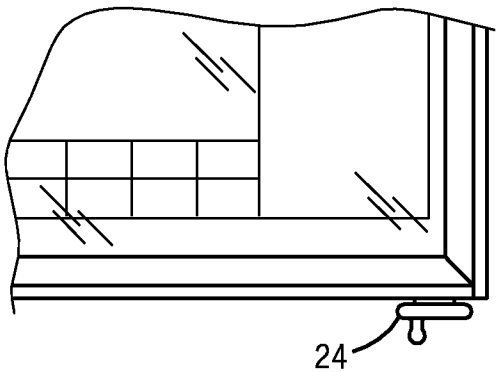
FIG. 3 is a partial top view of the scrolling multi-game table of FIG. 1.

A mechanism 24 for scrolling through the various game surfaces is also attached to the table frame assembly 12. As shown in FIG. 2, in a preferred embodiment, the mechanism 24 is comprised of a pair of roller control knobs 24 attached to the table frame assembly 12. A roller control knob 24 is located on each of the side members 14 of the table frame assembly 12 as shown, and are further located on opposing ends of the multi-game table 10. As shown in FIG. 3, in one embodiment, the roller control knobs 24 are configured to be manually turned by an operator to effectuate scrolling of the game surfaces 22 from one to the next. By turning the roller control knob 24, an operator aligns a desired game surface 22 with the top surface 20, so as to be visible therethrough. Alternatively, the scrolling of the game surface 22 can be controlled electronically, as will be described in greater detail later on.

Figure 4:
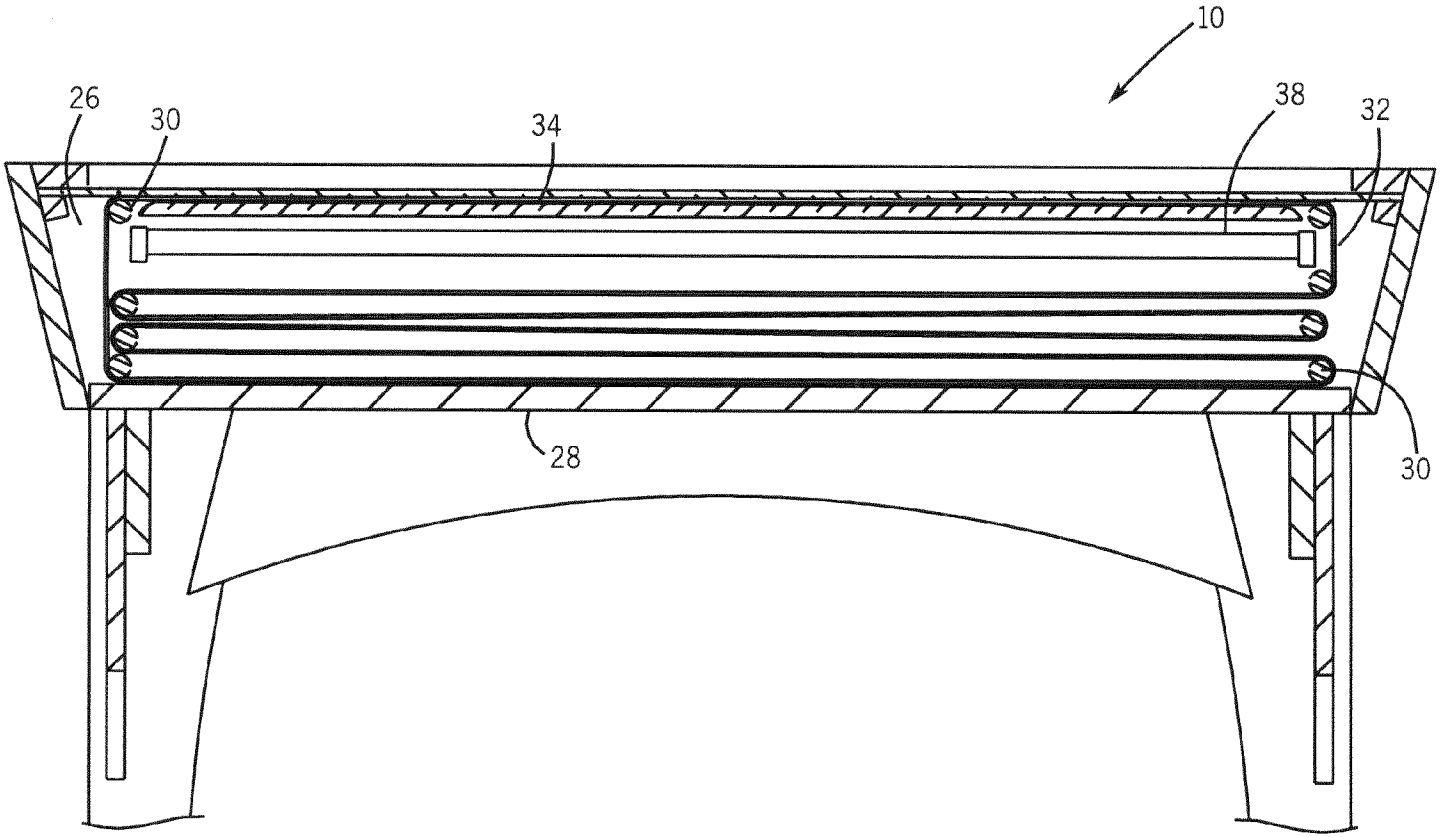
FIG. 4 is a cross-sectioned side view of the scrolling multi-game table of FIG. 1 taken along line 4-4 of FIG. 2.

Referring now to FIG. 4, a cavity 26 located on the interior of the multi-game table 10 is shown, along with the components contained therein. The cavity 26 is formed by the table frame assembly 12, bottom surface member 28, and top surface 20. Enclosed in the cavity 14, are a plurality of rollers 30 and a sheet 32 (i.e., game belt) wound about the rollers 30. The sheet 32 contains a plurality of game surfaces 22 thereon. In a preferred embodiment, the sheet 32 is a singular, continuous sheet comprised a flexible polymeric substance suitable for printing the plurality of game surfaces 22 thereon; however, it is envisioned that the sheet 32 be comprised of any material which is durable enough to be repetitively wound through and about the plurality of rollers 30 and which can retain the plurality of game surfaces 22 thereon. The sheet 32 can be wound about or through the plurality of rollers 30 in a variety of configurations depending on the number of rollers 30 present in the multi-game table 10.

As shown in the embodiment of FIG. 4, rollers 30 are oriented so as to be parallel to the end members 16 of the table frame assembly 12. Rollers 30 are further positioned adjacent to each of the end members 16 of the table frame assembly 12, although it is envisioned that rollers 30 could also be parallel to the side members 14. Sheet 32 is wound between the plurality of rollers 30 in a generally S-shaped manner; however, other configurations are certainly contemplated, such as a simple C-shaped rotator pattern if less games are desirable. Alternatively, a more complex pattern can be used for more games. Also shown in FIG. 4, is display member 34, which functions as a surface over which the game surface 22 to be displayed can be stretched. In the preferred embodiment, the sheet 32 will be supported and stretched by display member 34 as it passes between the pair of rollers 30 closest to the top surface 20. The portion of the sheet 32 adjacent to display member 34 is the game surface 22 that an operator has selected and is thus visible through the transparent top surface 20.

In another possible embodiment of the invention, which is not shown, the entirety of the sheet 32 is wound about a single roller, similar to a window shade type configuration. The sheet 32 is then stretched to attach to an additional roller located at the opposite end of the table frame assembly 12. Roller control knobs 24 are turned to effectuate scrolling of the sheet 32 between the two rollers and display desired game surfaces 22. Display member 34 again functions as a surface over which the game surface 22 to be displayed can be stretched. The sheet 32 will be supported and stretched by display member 34 as it passes between the pair of rollers to provide an optimal view of the game surface 22. The portion of the sheet 32 adjacent to display member 34 is the game surface 22 that an operator has selected and that is visible through top surface 20.

Another mechanism that is envisioned for stretching the sheet 32, includes rollers 30 configured to have a ratchet 36 mounted to the end thereof. The ratchet 36 functions as a mechanism for tensioning the sheet 32 and equalizing pressure on that portion of the sheet 32 on which a desired game surface 22 is located. This insures that the game surface 22 being displayed through the transparent top surface 20 is free of any surface irregularities that may visibly affect use of the multi-game table 10. Ratchet 36 is configured in a manner well known in the art and tensions sheet 32 to prevent rotation of the rollers 30 in a backward motion from its intended direction of rotation.

As shown in FIG. 4, multi-game table 10 also includes a lighting system 38 configured to illuminate game surface 22 that is visible through top surface 20. In a preferred embodiment, the lighting system 38 illuminates game surface 22 from below by being positioned beneath display member 34 and sheet 32. In this embodiment, display member 34 is constructed of a translucent or transparent material, so as to allow light to be shone there through and illuminate game surface 22. While such a position of lighting system 38 is preferred, it is envisioned that lighting system 38 can be located in any location that adequately illuminates game surface 22, so long as it does not interfere with use of the multi-game table 10.

Referring now to FIG. 5, the rollers 30 heretofore identified are described in greater detail. In a preferred embodiment, rollers 30 are comprised of a tube or cylinder 40 having an end cap 42 secured thereto on each end of the cylinder 40. The end cap 42 has a flange 44 which contributes to preventing the sheet 32 from being wound askew or becoming off-center on the rollers 30. End cap 42 also contains a fixedly mounted hub 46 inserted centrally in the end cap 42 at each end of the roller 30. The hub 46 joins with a bracket 48 to support the hub 46 and attached roller 30. Bracket 48 is secured to the table frame assembly 12 at point 50 and also to the bottom surface member 28. Bracket 48 is further configured with an opening to allow for passage of a table driveshaft 52 therethrough. Table driveshaft 52 is secured at one end to hub 46 of one of the plurality of rollers 30 and connects at the opposite end to roller control knob 24. Table driveshaft 52 is further fitted with bushing 54 to reduce wear on the table driveshaft 52. Bushing 54 runs from bracket 48 thru table frame assembly 12, to mesh with the outer surface of a side member 14. Bushing 54 makes a tight fit where it passes through the hole in bracket 48 and in the side member 14 of table frame assembly 12. End cap 42 and hub 46 are securely fastened to roller 30 to prevent rotating there between.

Figure 6:
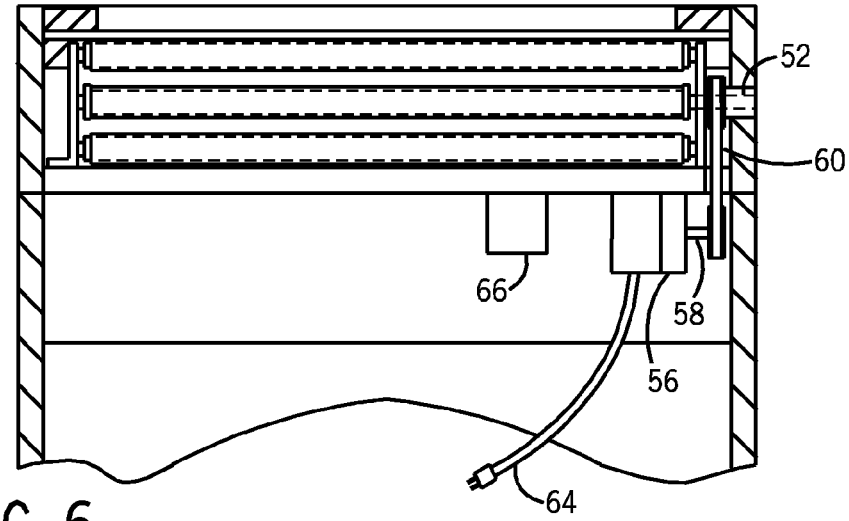
FIG. 6 is a cross-sectioned side view of an alternate embodiment of the scrolling multi-game table of FIG. 1 taken along line 4-4 of FIG. 2.

FIG. 6 shows an alternate embodiment of multi-game table 10 of the current invention. As shown, multi-game table 10 contains a reversible electric motor 56. As a means for powering reversible electric motor 56 and the lighting system 38 previously described (shown in FIG. 4), a power cord 64 is electrically connected to multi-game table 10. Power cord 64 is configured to provide adequate electrical power to reversible electric motor 56 and/or lighting system 38. As an alternative means for power, a battery power source 66 can be disposed in or about cavity 26, to provide power to reversible electric motor 56 and/or lighting system 38.

Preferably, reversible electric motor 56 is mounted to bottom surface member 28, although it is also envisioned that the reversible electric motor can be mounted in another suitable location on the surface of the multi-game table 10 or in the cavity 26 thereof. Motor driveshaft 58 of reversible electric motor 56 in connected to table driveshaft 52, to drive rotation thereof in a forward or backward manner. In a preferred embodiment, motor driveshaft 58 is connected to table driveshaft 52 via a roller chain 60 configured to transmit power between the two driveshafts. However, it is also envisioned that any mechanism suitable for transmitting torque can be used to connect the motor driveshaft 58 and the table driveshaft 52.

Figure 7:
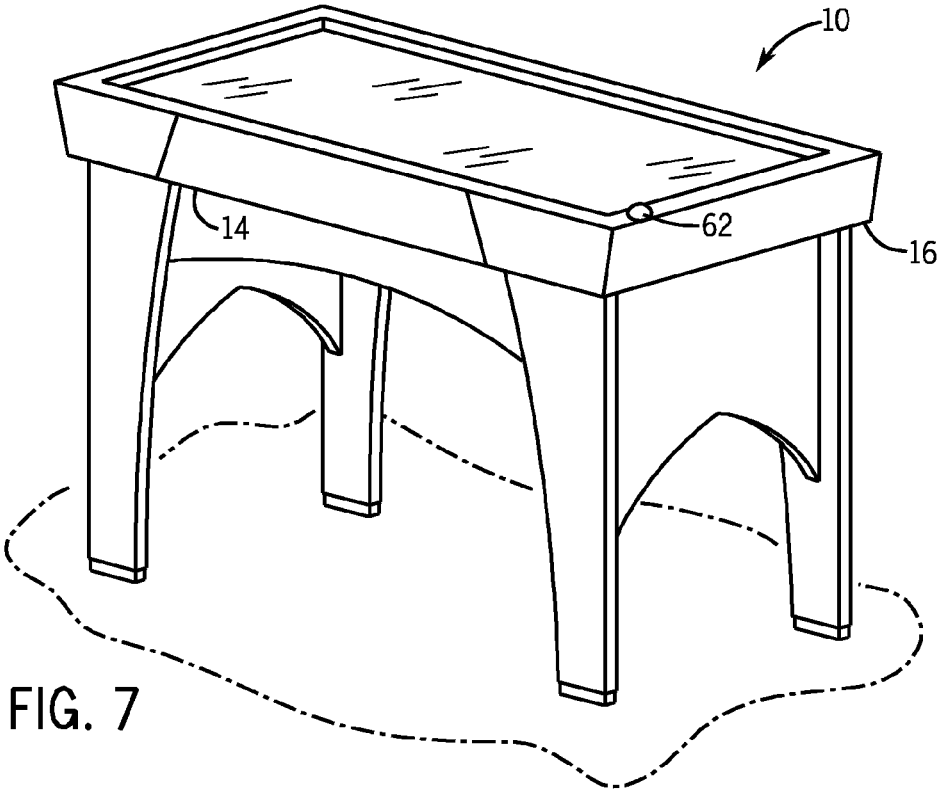
FIG. 7 is a perspective view of the alternate embodiment of the scrolling multi-game table of FIG. 6.

Referring now to FIG. 7, reversible electric motor 56 is controlled via switch 62 that is positioned along one of the end members 16 of the table frame assembly 12, or in a similar location that allows for an operator to easily reach switch 62. By flipping switch 62, operator is able to translate the sheet 32 to display different game surfaces 22 as desired. Switch 62 can be flipped in a forward or reverse direction that allows for sheet 32 to be translated in a corresponding forward or reverse direction. Reversible electric motor 56 is configured to then translate sheet 32 an appropriate distance to display the next game surface 22 adjacent to the game surface 22 currently shown.

Therefore, in accordance with one aspect of the present invention, a combination game table is disclosed that includes a table frame assembly having side members, end members, and a bottom surface member. The invention further includes a cavity located within the table frame assembly. A mechanism is positioned in the cavity and in contact with a sheet having a plurality of game surfaces printed thereon. The mechanism is configured to translate the sheet from one position to a next position.

According to another aspect of the present invention, a multi-game game table is disclosed. The table includes a table frame assembly, a transparent top surface member on a top side of the table frame assembly, and a plurality of rollers located in the table frame assembly. The rollers are configured to support a game belt having a plurality of game surfaces printed thereon, and are attached to a means for scrolling the game belt about the transparent top surface member to be visible therethrough.

According to yet another aspect of the invention, a method for manufacturing a combination game table is disclosed. The method includes the steps of constructing a table frame assembly having side members, end members, and a bottom surface and disposing a scrolling mechanism within a cavity formed by the table frame assembly. The method further includes the step of connecting a sheet having a plurality of game surfaces printed thereon to the scrolling mechanism, such that the scrolling mechanism is in contact with the sheet to scroll the sheet from one position to a next position.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A combination game table comprising:

a table frame assembly having side members, end members, and a bottom surface member;

a cavity located within the table frame assembly;

a plurality of rollers positioned within the cavity;

a sheet wound about the plurality of rollers and having a plurality of game surfaces thereon;

an electric motor mounted to the table frame and generating an output to turn the plurality of rollers to selectively translate the sheet from one position to a next position, and an electric switch configured to control operation of the electric motor to position one of the plurality of game surfaces in alignment with the top surface, and wherein a different one of the plurality of game surfaces is positioned in alignment with the top surface with each activation of the electric switch.

2. The combination game table of claim 1 wherein at least one of the plurality of rollers is located at each of the end members and parallel thereto.

3. The combination game table of claim 1 wherein the sheet is wound about one of the plurality of rollers and stretchedly connected to another of the plurality of rollers.

4. The combination game table of claim 1 wherein the sheet is formed about the plurality of rollers in a substantially S-shaped configuration.

5. The combination game table of claim 1 wherein the sheet comprises a continuous sheet of a flexible polymeric substance suitable for being wound through the plurality of rollers and to retain a printed game surface thereon.

6. The combination game table of claim 1 further comprising a pressure equalization assembly configured to tension the sheet and equalize the pressure applied by the plurality of rollers on opposing ends of the sheet.

7. The combination game table of claim 1 further comprising a top surface situated within the table frame assembly, wherein the top surface is transparent.

8. The combination game table of claim 7 further comprising a lighting system configured to illuminate the game surface in alignment with the top surface.

9. The combination game table of claim 1 further comprising a table drive shaft connected to one of the plurality of rollers.

10. A multi-game game table comprising:

a table frame assembly;

a transparent top surface member on a top side of the table frame assembly;

a plurality of rollers located in the table frame assembly, wherein the rollers support a game belt having a plurality of games thereon;

a table drive shaft having a first end connected to one of the plurality of rollers to drive rotation thereof; and a motorized drive system to drive rotation of the table drive shaft to scroll the game belt to display a desired game through the transparent top surface member, the motorized drive system comprising:

a reversible electric motor to generate a rotational power in either a forward or reverse direction;

a motor drive shaft to receive the rotational power and rotate in one of the forward or reverse direction responsive thereto; and a roller chain connected to the motor drive shaft and to a second end of the table drive shaft to transmit the forward or reverse rotation from the motor drive shaft to the table drive shaft to turn the plurality of rollers in either the forward or reverse direction.

11. The multi-game game table of claim 10 further comprising a switch configured to control operation of the motorized drive system to position one of the plurality of games in alignment with the transparent top surface member, and wherein a different one of the plurality of games is positioned in alignment with the transparent top surface member with each push of the button.

12. The multi-game game table of claim 11 wherein the switch is configured to control operation of the motorized drive system to drive rotation of the table drive shaft in the forward direction when actuated to a first position and drive rotation of the table drive shaft in the reverse direction when actuated to a second position.

13. The multi-game game table of claim 10 wherein at least one of the plurality of rollers is located at each of an end member of the table frame assembly parallel and adjacent to the end member.

14. The combination game table of claim 10 further comprising a display member situated within the table frame assembly and configured to support the sheet at a position below the game that is visible through the transparent top surface member.

15. The combination game table of claim 10 wherein the plurality of games includes at least two of a table tennis surface, an air hockey surface, a chess surface, a backgammon surface, a table soccer surface, a shuffle board surface, a bowling surface, a checkers surface, and a pool surface.

16. The combination game table of claim 10 further comprising a lighting system configured to illuminate the game in alignment with the transparent top surface member.

* * * * *